United States Patent [19]

Jacobs et al.

[11] Patent Number: 4,492,390

[45] Date of Patent: Jan. 8, 1985

[54] COMBINED AIRLINE TICKET HOLDER AND ADVERTISING BOOKLET

[75] Inventors: Anthony S. Jacobs, Glencoe; James E. Riley, Deerfield; Jon D. Christman, Northbrook, all of Ill.

[73] Assignee: The Wessel Company, Inc., Elk Grove Village, Ill.

[21] Appl. No.: 294,453

[22] Filed: Aug. 20, 1981

[51] Int. Cl.[3] ..... B42D 3/12

[52] U.S. Cl. ..... 281/31; 283/56; 150/147; 229/72

[58] Field of Search ..... 281/31, 38, 16; 283/23, 283/56, 42; 282/25; 206/807, 460, 459, 447; 150/39; 229/72; 40/359

[56] References Cited

U.S. PATENT DOCUMENTS

| | | | |
|---|---|---|---|
| 324,584 | 8/1885 | Payne | 283/42 |
| 1,017,006 | 2/1912 | Lee | 281/31 X |
| 2,982,322 | 5/1961 | Seitz | D3/56 X |
| 3,086,694 | 4/1963 | Tucker et al. | D3/56 X |
| 3,446,260 | 5/1969 | Osher | 150/39 |
| 3,734,396 | 5/1973 | Cowan | 283/23 X |
| 3,941,309 | 3/1976 | Gendron | 282/25 X |
| 3,970,332 | 7/1976 | Alford, Jr. | 283/56 X |
| 3,979,051 | 9/1976 | Close | 229/72 |

FOREIGN PATENT DOCUMENTS

| | | | |
|---|---|---|---|
| 1279118 | 11/1961 | France | 281/31 |

OTHER PUBLICATIONS

Exhibit "A"—Copy of Airline Type Ticket Folder Having a Slit in the Front Cover.

*Primary Examiner*—Paul A. Bell

*Attorney, Agent, or Firm*—Marshall, O'Toole, Gerstein, Murray & Bicknell

[57] ABSTRACT

An airline ticket holder comprises a front cover and a back cover joined along a mutual inner edge or fold. A pocket is located between the two covers and is attached to the front cover. Located between the pocket and the back cover and attached to the covers adjacent the fold is a booklet comprising a plurality of pages each having advertising matter printed thereon.

22 Claims, 7 Drawing Figures

COMBINED AIRLINE TICKET HOLDER AND ADVERTISING BOOKLET

BACKGROUND OF THE INVENTION

The present invention relates generally to airline ticket holders and more particularly to a combined airline ticket holder and advertising booklet.

An ordinary airline ticket holder generally comprises a folder having a pair of covers joined together along a junction or fold with a pocket located between the covers and attached to one of the covers. The pocket has an outer edge joined to the one cover and an inner edge which is normally open to define a pocket entrance for receiving an airline ticket which is held within the pocket. Typical dimensions of an airline ticket holder are 3½"-4" wide by 8"-9" long.

The number of airline tickets sold annually in the U.S.A. numbers in the tens of millions. For each airline ticket sold, an airline ticket holder is provided. Airline passengers include a disproportionate number of persons whose income level is substantially higher than average and who include the pacesetters and trend setters with regard to the acquisition of goods and services.

Because of the huge number of airline ticket holders in circulation and because of the demographics of the persons to whom the airline ticket holders are distributed, airline ticket holders represent an unusually desirable medium for advertising goods and services. However, because of the scarcity of printing space available on the ordinary airline ticket holder, generally, and because of the even scarcer printing space available for advertising on an airline ticket holder (e.g., one or two cover surfaces), there is a severe restriction on the amount of goods and services which can be advertised on an airline ticket holder.

SUMMARY OF THE INVENTION

In accordance with the present invention, there is combined with the airline ticket holder an advertising booklet located between the covers of the ticket holder and attached to at least one of the covers, along the junction of the two covers. The advertising booklet comprises a plurality of pages, thereby increasing very substantially the amount of space which can be devoted to advertising.

In combining an advertising booklet with an airline ticket holder in the manner described above, there are a number of structural considerations which should be taken into account. For example, the advertising booklet must be located and disposed in relation to the pocket so as to permit an airline ticket to be inserted readily into the pocket without obstruction by the advertising booklet.

Moreover, desirably, the booklet should be so located and disposed in relation to the pocket, as well as being appropriately structurally configured, as to guide the airline ticket into the entrance of the pocket.

The lateral dimension of one cover of the folder should be greater than the lateral dimension of the booklet, and the lateral dimension of the other cover should be less than the lateral dimension of the booklet. The result of this lateral dimensional relationship is to facilitate thumbing readily of either of the covers without obstruction by the other of the covers or by the booklet and to facilitate thumbing readily of the booklet without obstruction by either of the covers.

To facilitate economical manufacturing, the longitudinal dimensions of both covers and of the booklet all should be the same, and the booklet should be attached to the airline ticket holder by adhesive.

Other features and advantages are inherent in the structure claimed and disclosed or will become apparent to those skilled in the art from the following detailed description in conjunction with the accompanying diagrammatic drawings.

DETAILED DESCRIPTION

Figure 7:
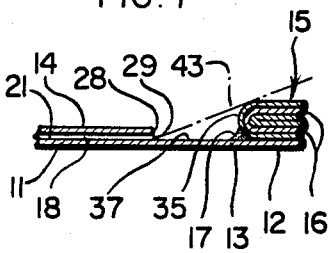
FIG. 7 is a fragmentary sectional view similar to that in FIG. 6, but with the booklet fully closed.
Figure 6:
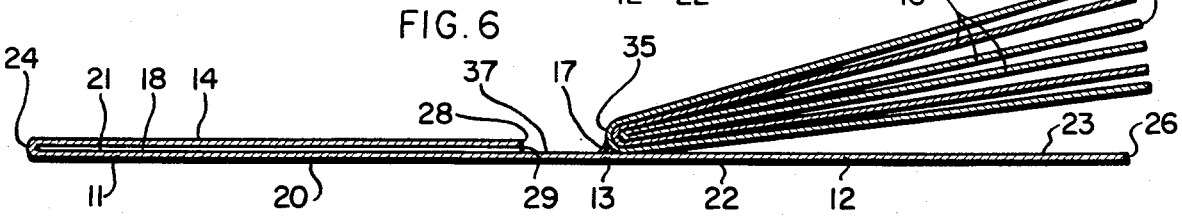
FIG. 6 is a sectional view taken along line 6—6 in FIG. 4, with the booklet partially pivoted and partially opened.

The figures illustrate an airline ticket holder comprising a planar front cover 11 and a planar back cover 12 joined together along a junction or fold 13. Located between front and back covers 11, 12 and attached to front cover 11 is a pocket member 14 which together with front cover 11 defines pocket means 18 for receiving and holding an airline ticket (FIGS. 6–7). Also located between the covers is an advertising booklet 15 comprising a plurality of pages 16, 16. Booklet 15 is attached to the airline ticket holder along junction 13 by adhesive means 17.

Figure 1:
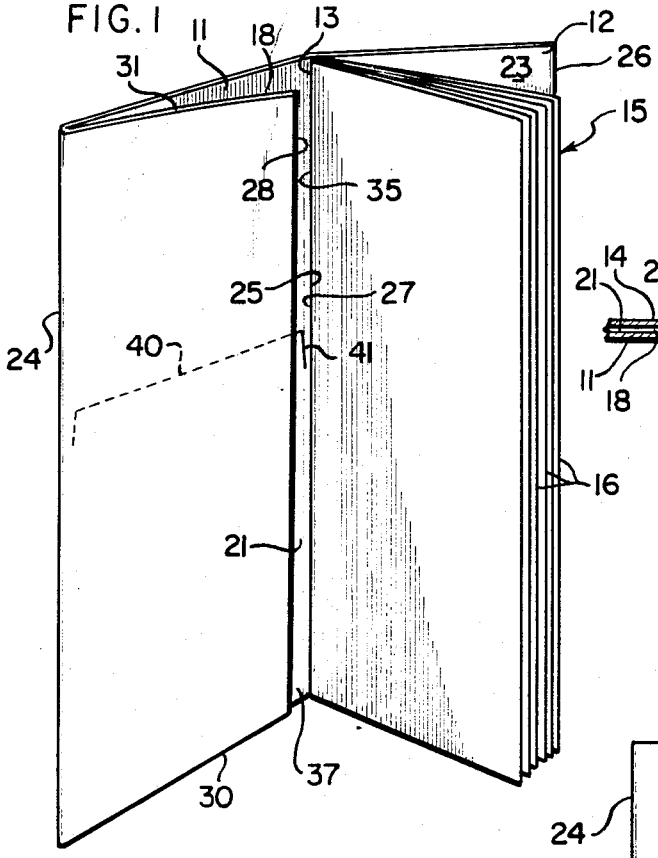
FIG. 1 is a perspective illustrating a combined airline ticket holder and advertising booklet in accordance with an embodiment of the present invention and showing the holder in an open condition.
Figure 2:
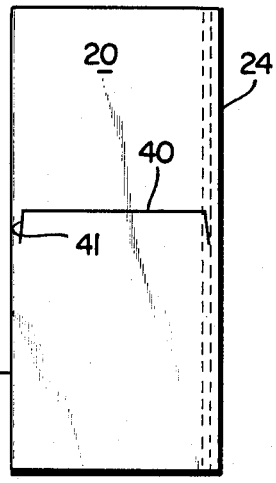
FIG. 2 is a front view of the combined holder and booklet.
Figure 3:
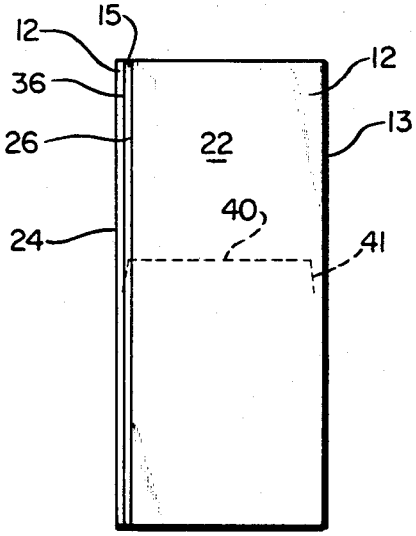
FIG. 3 is a rear view of the combined holder and booklet.
Figure 5:
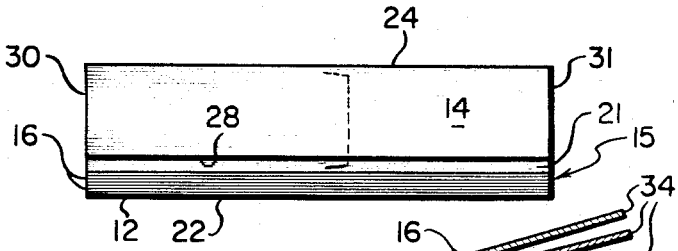
FIG. 5 is a side view of the combined holder and booklet with the front cover open.

Referring particularly to FIG. 6, front cover 11 is elongated and has an outer surface 20 and an inner surface 21. Back cover 12 is also elongated and has an outer surface 22 and an inner surface 23. Referring to FIGS. 2–3, front cover 11 and back cover 12 have respective first or outside longitudinal edge portions 24, 26, and a mutual second or inside longitudinal edge portion at fold 13.

Pocket member 14 is disposed along the inner surface 21 of front cover 11 and is attached to the front cover along the latter's first longitudinal edge portion 24. Pocket member 14 has an inner longitudinal edge portion 28 which is unattached to front cover 11. The gap between inner surface 21 of front cover 11 and the unattached portion of pocket member 14 along its inner longitudinal edge portion 28 constitutes a pocket entrance 29 for receiving an airline ticket. Pocket member 14 also comprises a first lateral edge portion 30 secured to front cover 11 and a second lateral edge portion 31 unsecured to either of the cover members 11, 12.

Figure 4:
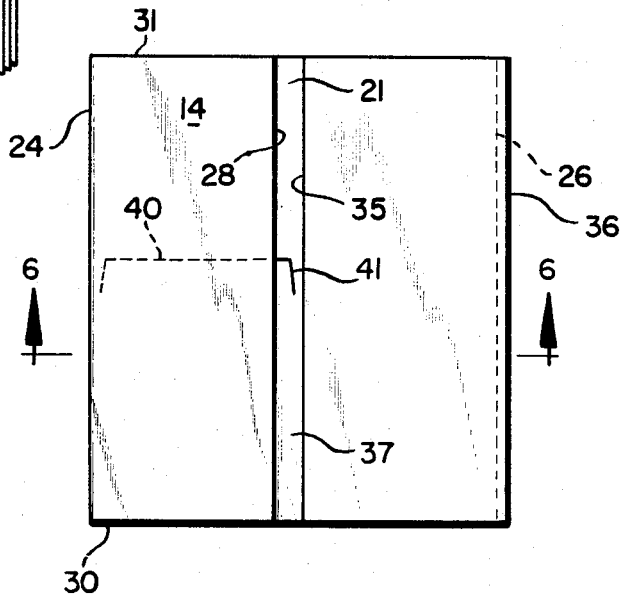
FIG. 4 is a plan view of the combined holder and booklet, viewed from the inside, with the holder in an open condition.

Advertising booklet 15 is located between pocket member 14 and the inner surface 23 of back cover 12. As noted above, advertising booklet 15 has a plurality of pages 16, 16, and each of these pages contains advertising matter printed thereon. Each page 16 has a first or outer longitudinal edge portion 34 and an inner or second longitudinal edge portion joined with the other inner longitudinal edge portions of the pages to define an inner longitudinal edge portion 35 of the booklet. The first or outer longitudinal edge portions 34, 34 of the pages are unjoined, and the laterally outermost of longitudinal edge portions 34, 34 defines the outer longitudinal edge portion 36 of the booklet (FIGS. 3–4). In the illustrated embodiment, all of the edge portions 34, 34 extend laterally outwardly an equal amount.

The booklet's inner longitudinal edge portion 35 is joined by adhesive means 17 to back cover 12 adjacent fold 13. The inner longitudinal edge portions of pages 16, 16 are joined together at 35 by adhesive means (not shown).

The booklet's inner longitudinal edge portion 35 and the pocket member's inner longitudinal edge portion 28 are laterally spaced from each other to define a space 37 therebetween and adjacent the pocket. Space 37 has a lateral dimension large enough to allow an airline ticket to be inserted readily into pocket 18 through pocket entrance 29 without obstruction by the booklet's inner longitudinal edge portion 35.

As noted above, the pocket member's inner longitudinal edge portion 28 is substantially free, and at least a substantial part of inner longitudinal edge portion 28 is unjoined to either of the covers 11, 12. Pocket entrance 29 is defined by the substantially free inner longitudinal edge portion 28, and space 37 is adjacent to and disposed alongside entrance 29.

In the illustrated embodiment, pocket member 14 is attached to front cover 11, advertising booklet 15 is attached to back cover 12 at junction 13 and the booklet is no closer to pocket 18 than is the junction 13 of the two covers 11, 12.

As is best shown in FIG. 3, the lateral dimension of back cover 12, which terminates at outer longitudinal edge portion 26, is less than the lateral dimension of booklet 15 terminating at outer longitudinal edge portion 36, and the lateral dimension of booklet 15 is less than the lateral dimension of front cover 11, which terminates at outer longitudinal edge portion 24. The result of this lateral dimensional relationship is to facilitate thumbing of either of the covers without obstruction by the other of the covers or by the booklet and to facilitate thumbing of the booklet without obstruction by either of the covers.

The longitudinal dimensions of both covers 11, 12 and of booklet 15 are all the same. This facilitates economical manufacture of the combined airline ticket holder and advertising booklet. In the illustrated embodiment, the longitudinal dimension of pocket member 14 also is the same as that of covers 11, 12, for reasons similar to those advanced in the preceding sentence.

Located in front cover 11 behind pocket member 14 is a lateral slit 40. Slit 40 is disposed between the front cover's first longitudinal edge portion 24 and fold 13, and the slit terminates at an inner end 41 spaced from fold 13 (FIGS. 2–3). Slit 40 comprises means for permitting the insertion of a portion of an airline ticket into pocket 18 from the outside of front cover 11. The slit's inner end 41 and the advertising booklet's inner longitudinal end portion 35 are laterally spaced apart a distance sufficient to permit the airline ticket portion to be inserted readily through slit 40 into the pocket without obstruction by the booklet's inner longitudinal edge portion 35.

Referring now to FIG. 7, indicated in dash-dot lines is a plane 43 which extends away from front cover 11 at pocket entrance 29 and is substantially tangential to the booklet's inner longitudinal edge portion 35. There is an angle between plane 43 and planar front cover 11, and this angle is substantially less than 30°, preferably less than 15°. The magnitude of the angle is determined by the thickness of booklet 15 and the width of spacing 37 between the booklet's inner longitudinal edge portion 35 and pocket entrance 29.

Plane 43 constitutes the guide path for directing an airline ticket into pocket 18 through pocket entrance 29. This guide path has a relatively small but substantial directional component perpendicular to the plane of front cover 11 and a relatively large directional component parallel to front cover 11. The parallel component substantially exceeds the perpendicular component when that part of the airline ticket closest to the pocket is at pocket entrance 29. If the guide path were too steep (i.e., too large an angle), there is a possibility that the leading edge of the airline ticket may get hung up on the inner surface 21 of front cover 11, thereby obstructing ready entry into pocket entrance 29. Conversely, if the guide path were too shallow (too small an angle), the leading edge of the airline ticket might not readily slip under the longitudinal edge portion 28 of pocket member 14, at pocket entrance 29. The angle is preferably greater than 3°.

As noted above, the lateral dimension of space 37 is an important consideration. In order to facilitate entry of an airline ticket into pocket entrance 29 without obstruction by the booklet's inner longitudinal edge portion 35, and in order to provide the desired angle for guide path 43 (FIG. 7), the width or lateral dimension of space 37 is, or course, substantially less than the lateral dimension of front cover 11 but should be greater than about 12% (preferably greater than about 18%) of the lateral dimension of front cover 11 which typically has a lateral dimension in the range $3\frac{1}{2}''$–4″. In a typical embodiment, front cover 11 is 3 13/16″ wide, and space 37 is 13/16″ wide or 21% of the width of the front cover.

The width of pocket member 14 in relation to the width of the airline ticket it is extended to receive is also an important consideration. In order to expose a longitudinal edge of a ticket received in the pocket and to enable one to readily grab hold of the longitudinal edge of the ticket when the latter is in the pocket, the lateral dimension of pocket member 14 should be less than the width of the ticket and preferably less than about 93% of the width of the ticket. For example, assuming a typical airline ticket width of about $3\frac{1}{4}''$, and a front cover 11 and space 37 with the lateral dimensions described in the preceding paragraph, the lateral dimension of pocket member 14 is 3″ or about 92% of the width of the ticket. The lateral dimension of pocket member 14 should also be at least about 75% of the width of the ticket in order to properly hold the ticket in the pocket.

Providing space 37 and pocket member 14 with lateral dimensions within the ranges described in the preceding two paragraphs is especially important where the longitudinal dimension of pocket member 14 is the same as that of front cover 11 so that ticket insertion into and removal from the pocket is through a side entrance such as 29 rather than a top entrance, such as at edge 31.

As used herein the term "advertising booklet" includes a booklet having other printed information therein in addition to advertising. The subject ticket holder may also be used with other passenger tickets, such as railway tickets, if such other tickets are of a similar size and shape as airline tickets, and, as used herein, the term "airline tickets" includes such other passenger tickets.

As shown in the drawings, the longitudinal dimensions of both covers 11, 12, of pocket member 14 and of booklet 15 are all the same. The lateral dimension of each cover 11, 12 and of pocket member 14 is constant along the entire length thereof, as is the lateral dimension of each booklet page 16.

The foregoing detailed description has been given for clearness of understanding only, and no unnecessary limitations should be understood therefrom, as modifications will be obvious to those skilled in the art.

We claim:

1. An article of manufacture comprising:
a pair of covers joined together along a junction;
a booklet comprising a plurality of pages;
said booklet being located between said covers;
means attaching said booklet to a cover;
and means on said article for holding an object;
said pair of covers, said booklet pages, and said holding means having lateral and longitudinal dimensions;
each booklet page being joined together along an inner longitudinal edge portion and having an unjoined longitudinal edge portion;
the longitudinal dimensions of both covers, of said booklet pages and of said holding means being the same;
the lateral dimension of each cover and of each booklet page being constant along the entire length thereof;
all of said booklet pages having substantially the same lateral dimension;
the lateral dimension of one cover being different than the lateral dimension of said booklet pages along substantially the entire length of each to facilitate thumbing readily of said one cover without obstruction by said booklet;
the lateral dimension of the other cover being different than the lateral dimension of said one cover to facilitate thumbing readily of said other cover without obstruction by said booklet and to facilitate thumbing readily of either of said covers without obstruction by another cover.

2. An article of manufacture as recited in claim 1 wherein:
the lateral dimension of said object holding means being different than the lateral dimension of said one cover along substantially the entire length of each.

3. An article of manufacture as recited in claim 1 wherein:
said means for holding an object comprises pocket means located between said covers and attached to one of said covers.

4. An article of manufacture as recited in claim 3 and comprising:
a lateral slit in said one cover communicating with the interior of said pocket means.

5. In combination, an airline ticket holder and an advertising booklet, said combination comprising:
a pair of covers joined together along a junction;
pocket means located between said covers and attached to one of the covers;
said pocket means comprising means for receiving and holding an airline ticket;
and an advertising booklet comprising a plurality of pages;
said advertising booklet being located between said covers;
and means attaching said booklet to a cover;
said pair of covers, said pocket means and said advertising booklet pages having lateral and longitudinal dimensions;
each booklet page being joined together along an inner longitudinal edge portion and having an unjoined outer longitudinal edge portion;
the longitudinal dimensions of both covers being the same;
the lateral dimension of each cover and of each booklet page being constant along the entire length thereof;
all of said booklet pages having substantially the same lateral dimension;
the lateral dimension of each cover being different than the lateral dimension of said booklet pages and also different than the lateral dimension of the other cover to facilitate thumbing readily of either cover without obstruction by said booklet and to facilitate thumbing readily of either of said covers without obstruction by the other cover.

6. A combination as recited in claim 5 wherein:
the lateral dimension of one cover is greater than the lateral dimension of said booklet;
and the lateral dimension of the other cover is less than the lateral dimension of said booklet.

7. A combination as recited in claim 5 wherein:
the longitudinal dimensions of both covers and of said booklet are all the same.

8. A combination as recited in claim 7 wherein:
the longitudinal dimension of said pocket means is the same as the longitudinal dimension of said covers.

9. A combination as recited in claim 5 and comprising:
an inner longitudinal edge portion on said pocket means laterally spaced from said inner longitudinal edge portions of the booklet pages;
said inner longitudinal edge portions of (a) the pocket means and (b) the booklet pages defining a space therebetween;
the lateral dimension of said pocket means being constant along the length thereof;
a lateral slit in said front cover behind said pocket means;
said slit comprising means for permitting the insertion of a pocket of an airline ticket into said pocket means from the outside of said front cover;
said slit having an inner end extending into said space, said inner end being located closer to said inner longitudinal edge portions of the booklet pages than is any part of said pocket means;
said inner end of the slit and said advertising booklet being laterally spaced apart a distance sufficient to permit said airline ticket portion to be inserted readily into said pocket means without obstruction by said booklet.

10. A combination as recited in claim 5 wherein:
said pocket means has a side entrance;
there is a space between said side entrance and said advertising booklet;

and said space has a lateral dimension which is substantially less than the lateral dimension of said one cover but greater than 12% thereof.

11. A combination as recited in claim 10 wherein:

said space has a lateral dimension greater than 18% of the lateral dimension of said one cover.

12. A combination as recited in claim 10 wherein:

said pocket means has the same longitudinal dimension as said one cover.

13. A combination as recited in claim 5 wherein said combination is intended for used with an airline ticket having a predetermined lateral dimension and a longitudinal edge and wherein:

said pocket means has a constant lateral dimension along the entire length thereof and which is sufficiently less than the lateral dimension of the airline ticket to expose the longitudinal edge of said ticket when the latter is in the pocket means and to facilitate grabbing hold of said ticket.

14. A combination as recited in claim 13 wherein:

said pocket means has a lateral dimension sufficiently large in relation to the lateral dimension of the ticket to hold the ticket in the pocket means.

15. A combination as recited in claim 14 wherein:

said pocket means has a lateral dimension which is in the range of about 75–93% of the lateral dimension of the ticket.

16. A combination as recited in claim 5 wherein:

said covers comprise an elongated front cover and an elongated back cover, each having outer and inner surfaces and first and second longitudinal edge portions;

said front cover and back cover being joined along the second longitudinal edge portion of each;

said pocket means comprises a member disposed along the inner surface of said front cover and attached to the front cover;

said pocket member and said front cover are longitudinally coextensive and comprise means defining a pocket having an entrance for receiving and holding an airline ticket;

said booklet is located between said pocket and the inner surface of said back cover;

each of said booklet pages has first and second longitudinal edge portions;

said plurality of pages are joined together along their second longitudinal edge portions to define an inner longitudinal edge portion of said booklet;

the first longitudinal edge portions of said pages are unjoined and the laterally outermost of said first longitudinal edge portions define an outer longitudinal edge portion of said booklet;

the inner longitudinal edge portion of said booklet is joined to at least one of said covers adjacent the second longitudinal edge portions of each cover;

said pocket member has a first longitudinal edge portion, joined to the first longitudinal edge portion of said front cover, and a second longitudinal edge portion;

said second longitudinal edge portion of the pocket member is spaced laterally from the pocket member's first longitudinal edge portion;

the lateral dimension of said pocket member being constant along the entire length thereof;

said inner longitudinal edge portion of said advertising booklet and said second longitudinal edge portion of said pocket member are laterally spaced from each other to define a space therebetween adjacent said pocket;

said space comprising means, including the lateral dimension of said space, for allowing an airline ticket to be inserted readily into said pocket through said entrance without obstruction by the inner longitudinal edge portion of said advertising booklet.

17. A combination as recited in claim 16 and comprising:

a lateral slit in said front cover behind said pocket member;

said slit extending laterally between said first and second longitudinal edge portions of the front cover and terminating at an inner end extending into said space adjacent said pocket and spaced from the front cover's second longitudinal edge portion;

said slit comprising means for permitting the insertion of a portion of an airline ticket into said pocket from the outside of said front cover;

said inner end of the slit being located closer to the inner longitudinal edge portion of the booklet than is any part of said pocket member;

said inner end of the slit and said inner longitudinal edge portion of said advertising booklet being laterally spaced apart a distance sufficient to permit said airline ticket portion to be inserted readily into said pocket without obstruction by the inner longitudinal edge portion of said booklet.

18. A combination as recited in claim 16 and comprising:

adhesive means joining together the second longitudinal edge portions of said booklet pages and joining the inner longitudinal edge portion of said booklet to at least one of said covers.

19. A combination as recited in claim 8 wherein:

the lateral dimension of said pocket means is constant along the entire length thereof.

20. A combination as recited in claim 5 wherein:

said pocket means comprises a pocket member having a first lateral edge portion secured to said one cover and a second lateral edge portion unsecured to either of said covers.

21. A combination as recited in claim 5 and comprising:

adhesive means attaching said booklet to at least one of said covers.

22. A combination as recited in claim 5 wherein:

each of said covers has an inner longitudinal edge portion at said junction and an outer longitudinal edge portion spaced from said inner longitudinal edge portion by the lateral dimension of the cover;

said pocket means has an outer longitudinal edge portion corresponding to the outer longitudinal edge portion of said one cover to which the pocket means is attached and an inner longitudinal edge portion spaced from said outer longitudinal edge portion by the lateral dimension of the pocket means;

the lateral spacing between the outer longitudinal edge portion of the pocket means and said junction is greater than the lateral spacing between said junction and the outer longitudinal edge portion of the other cover and between said junction and the outer longitudinal edge portion of any booklet page;

said inner longitudinal edge portion of a booklet page is located at said junction;

the lateral spacing between the outer longitudinal edge portion of a booklet page and said junction being greater than the lateral spacing between the outer longitudinal edge portion of said other cover and the junction;

the outer longitudinal edge portion of said other cover being separated from said one cover, when the covers are closed, by a multiplicity of page thicknesses corresponding to the number of pages in said booklet.

* * * * *

UNITED STATES PATENT AND TRADEMARK OFFICE

CERTIFICATE OF CORRECTION

PATENT NO. : 4,492,390

DATED : January 8, 1985

INVENTOR(S) : Jacobs, et al.

It is certified that error appears in the above-identified patent and that said Letters Patent is hereby corrected as shown below:

Column 6, line 54, "pocket" (first occurrence) should be -- portion --.

Signed and Sealed this

*Eighteenth* Day of *June 1985*

[SEAL]

*Attest:*

DONALD J. QUIGG

*Attesting Officer*

*Acting Commissioner of Patents and Trademarks*